United States Patent [19]

Schiffmann

[11] 4,033,094

[45] July 5, 1977

[54] APPARATUS FOR ORIENTING AND FOR AUTOMATICALLY PILING UP BOBBINS OF YARN

[75] Inventor: Anton Schiffmann, Staad, Switzerland

[73] Assignee: Arova Rorschach AG, Switzerland

[22] Filed: June 22, 1976

[21] Appl. No.: 698,598

[30] Foreign Application Priority Data

June 24, 1975 Switzerland ..... 8219/75

[52] U.S. Cl. ..... 53/242

[51] Int. Cl.[2] ..... B65B 5/10

[58] Field of Search ..... 53/242, 243, 35, 142

[56] References Cited

UNITED STATES PATENTS

| | | | |
|---|---|---|---|
| 2,786,315 | 3/1957 | Schweiter | 53/242 X |
| 3,435,586 | 4/1969 | Scherr | 53/242 |
| 3,508,377 | 4/1970 | Banks | 53/242 X |
| 3,576,094 | 4/1971 | Savageau et al. | 53/242 X |

*Primary Examiner*—Travis S. McGehee

*Attorney, Agent, or Firm*—Larson, Taylor and Hinds

[57] ABSTRACT

Bobbins of yarn wound up on a winding device of a winding-up machine slide under gravity along a channel that maintains the orientation of the bobbins, both axially and in regard to the sense in which the yarn is wound, as determined by the winding device. Each bobbin dwells at a positioning device at the lower end of the channel through which a thrust member rises to carry the bobbin through an opening in the base of a container in which the bobbins are later carried away for further processing. The opening is normally closed by two flaps that lie edge to edge across the opening but are separated against spring action by the rising bobbin. The thrust member and plates carrying the flaps are so shaped that the flaps can immediately return to their closing positions beneath the bobbin when this has nearly wholly entered the container. The container may be inclined or have inclined base walls to enable the bobbins to pile up therein while always remaining in their initial orientation.

2 Claims, 2 Drawing Figures

APPARATUS FOR ORIENTING AND FOR AUTOMATICALLY PILING UP BOBBINS OF YARN

FIELD OF THE INVENTION

The present invention relates to an apparatus and process for orienting and for automatically collecting bobbins of yarn in a temporary container after the bobbins have been wound up on a winding device of a winding-up machine, the temporary container enabling the bobbins to be removed for further processing.

From the prior art, no such apparatus or process for orienting and for automatically collecting the woundup bobbins of yarn is known. The known winding-up machines instead expel the bobbins without orienting them.

Since the wound-up bobbins of yarn are processed further, for example provided with a protective cover and/or a label and thereafter packed, the bobbins of yarn have to be oriented and collected. The orientation of the bobbins of yarn must then take place in the axial direction and also depends on the sense in which they are wound.

SUMMARY OF THE INVENTION

Accordingly, it is one purpose of the present invention to provide a process of the above-mentioned kind which makes possible an orientation of the bobbins of yarn in the axial direction and according to the sense of the winding-up of the yarn and which, furthermore, can be effected automatically, i.e. without any auxiliary personnel and above all continuously, i.e. immediately after completion of each bobbin of yarn.

Another purpose of the present invention is to provide means which render possible automatic collecting of the bobbins of yarn while maintaining the orientation thereof.

According to the present invention, these purposes are primarily achieved by removing the finished bobbin of yarn from the winding-up machine and by feeding the bobbin to a receiving station while maintaining a certain orientation which is determined by the winding-up machine and that, thereafter, the oriented bobbin is fed by the receiving station to the temporary container while maintaining the orientation of the bobbin and is collected in the container.

According to the present invention, a process for orienting and for automatically collecting bobbins of yarn is effected in a most simple manner by maintaining the orientation of the bobbin of yarn determined by the winding-up machine during the winding-up process after the winding-up process and after expulsion of the bobbin of yarn from the winding-up machine, and the thus oriented bobbin of yarn being then fed to the receiving station. In the receiving station, the bobbin of yarn is then fed to the temporary container in which the bobbins of yarn are then piled up or collected.

In an advantageous embodiment of the present invention, the bobbin of yarn is fed to the temporary container from below whereby the orientation of the bobbin of yarn during and after collection can be maintained safely.

Another purpose of the present invention consists in providing an apparatus for effecting the process of the present invention which renders possible easy, rapid, safe and above all economic orientation and collection of bobbins of yarn.

According to the present invention, this is primarily achieved by providing, for feeding the bobbin of yarn to the receiving station, an inclined channel the width of which is less than the length of the bobbin of yarn and larger than the outer diameter of the bobbin of yarn, the receiving station comprising a transport device (such as a lifting unit) for introducing the bobbin of yarn into the temporary container, and the receiving station and/or the transport device comprising a positioning device for exactly fixing the position of the bobbin of yarn, the temporary container being inclined and/or having inclined walls for maintaining the orientation of the bobbins of yarn contained therein, and the temporary container comprising a closable opening through which the bobbins of yarn are introduced.

This permits in a very simple manner the provision of an apparatus for orienting and for collecting bobbins of yarn for very little expenditure and which has only a few moving parts so that it works reliably.

By the inclined arrangement and/or by inclined base walls of the temporary container, furthermore, the orientation of the bobbins of yarn within the temporary container is reliably conserved.

In an advantageous embodiment of the apparatus of the present invention, the transport device is a lifter unit that comprises a thrust member having a slot and/or a groove for positioning the bobbin of yarn, the slot and/or the groove having a width and a depth which correspond to the bobbin of yarn. Thereby, it is possible in a very simple manner precisely to position the bobbin of yarn on the thrust member. Such a thrust member can be reliably used for bobbins of yarn of different diameters without the necessity of replacing the thrust member. The thrust member may be actuated mechanically, hydraulically and/or pneumatically.

The temporary container and/or the receiving station may comprise at least one closing flap actuatable by the bobbin of yarn and arranged to swing against the force of a spring. The flap can only by opened when the thrust member introduces a bobbin of yarn into the temporary container. After introduction of the bobbin of yarn and while the thrust member returns to its idle position, the flap closes the temporary container so that bobbins of yarn which have already been placed in the container are safely prevented from sliding out of the container.

As can be seen, the technical progress and the inventive character of the object of the present invention are assured by the new individual features as well as particularly by combination and sub-combination of the features used.

DESCRIPTION OF THE DRAWINGS

The invention will be explained hereinafter in more detail with reference to the accompanying drawings in which:

As shown in FIGS. 1 and 2, the apparatus for orienting and for collecting bobbins of yarn includes an inclined channel 1 which guides each wound-up bobbin of yarn 2 from a winding device of a winding-up machine (not shown in detail) to a receiving station 4. The channel 1 has a width which is smaller than the length and larger than the outer diameter of the bobbin of yarn 2 so that the bobbin of yarn cannot turn upside down within the channel 1 and can only move lengthwise while maintaining the orientation which was imparted to it by the winding device of the winding-up machine.

Figure 1:
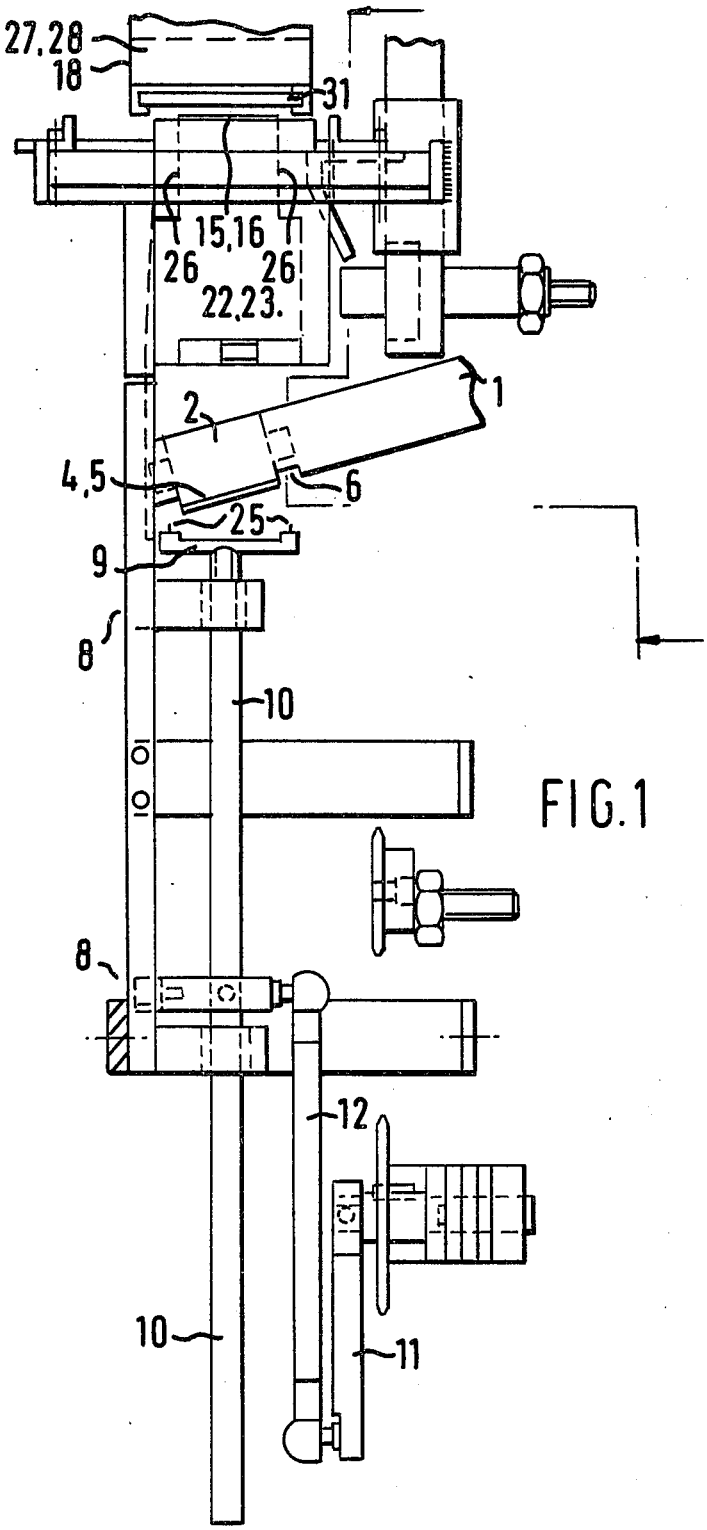
FIG. 1 shows a lateral elevation of apparatus for orienting and for collecting bobbins of yarn.

The inclination of the channel 1 is such that bobbins of yarn lying in the channel move downwards under gravity, and the receiving station 4 comprises a positioning device 5 in the shape of an aperture 6 in the lower extremity of the channel 1 for exactly positioning the bobbins of yarn 2. The aperture 6 is of such dimensions that bobbins of yarn of various diameters are safely and exactly located, but that the bobbins of yarn cannot fall through the aperture.

The receiving station 4 furthermore comprises a lifting unit 8 consisting of a thrust member 9, a lifting rod 10 and a driving mechanism 13 consisting of a crank 11 and connecting rod 12. The lifting unit 8 and particularly the driving mechanism 13 are driven by the winding-up machine itself by means of a chain or belt 30.

The aperture 6 and the thrust member 9 are of such dimensions that the thrust member 9 can easily pass with clearance through the aperture 6.

As can be seen, alternatively, the thrust member 9 can exactly fit the aperture 6 and completely fill the latter during its passage through the aperture.

Figure 2:
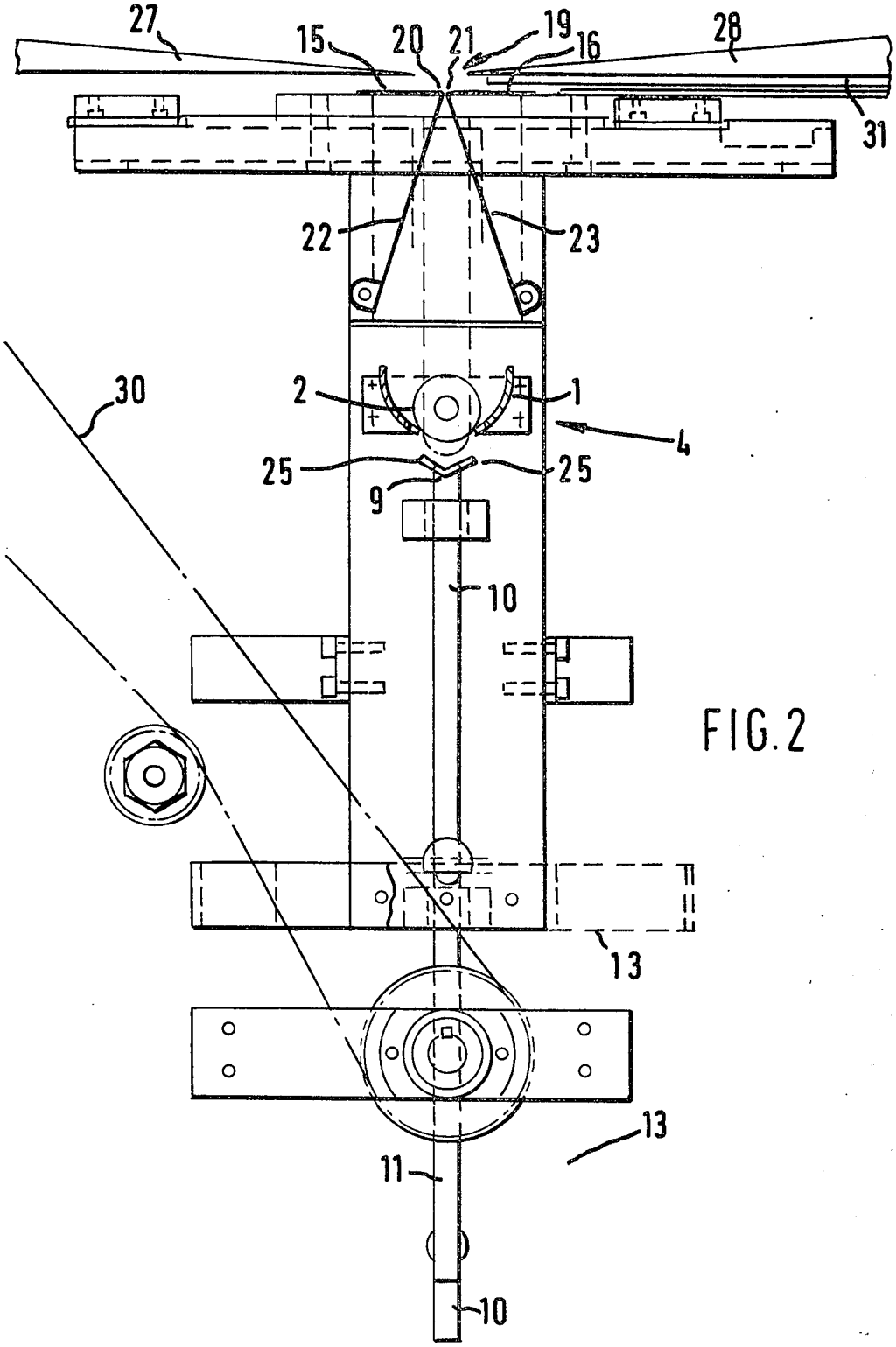
FIG. 2 shows a front elevation of the apparatus of FIG. 1.

As shown particularly in FIG. 2, the receiving station 4 furthermore comprises two closing flaps 15, 16 actuatable by the pusher 9 or more precisely by the bobbin of yarn 2 arranged thereon, that can separate against the force of two springs (not shown). This prevents bobbins of yarn which have already been introduced from sliding out of a temporary container 18 arranged above the closure flaps. The flaps 15, 16 extend in opposite directions from the upper ends of two plates 22, 23 that converge in their idle positions shown in FIG. 2 and are pivoted at their lower edges.

The temporary container 18 has an opening 19 through which the bobbins of yarn 2 are introduced from below.

The thrust member 9 furthermore has such dimensions that the closure flaps 15 and 16 are separated only by the bobbin of yarn 2 lying on the thrust member. The stroke of the thrust member 9 is then chosen so that the latter never moves beyond the adjacent edges 20, 21 of the closure flaps 15, 16.

When introducing a bobbin of yarn into the temporary container 18, therefore, the pusher 9 is continuously lifted, and the closer flaps 15 and 16 are opened by the bobbin of yarn 2. As soon as the longitudinal axis of the bobbin of yarn moves beyond the level of the mutually facing edges 20, 21 of the closure flaps 15, 16, the bobbin of yarn 2 is lifted further because of the resilient force on the under side of the bobbin due to the springs (not shown) acting on the closure flaps. The closure flaps continue to close until the plates 22, 23 take up the position of FIG. 2. Thereby, bobbins of yarn which have already been fed into the temporary container 18 are safely prevented from falling out of the temporary container, while the thrust member 9 is still in its uppermost position and the closure flaps 15 and 16 possibly are not yet entirely closed together.

Complete closing of the closure flaps 15, 16 can take place while the thrust member 9 is in its uppermost position because the plates 22, 23 are formed with lateral recesses 26 that enable them to clear projections 25 on the thrust member 9 that provide cradles (corresponding to the diameter of the bobbin) for lifting the bobbin.

The temporary container 18 comprises, as shown particularly in FIG. 2, wedge-shaped bases 27, 28 inclined downwards so that the bobbins of yarn 2 fed into the temporary container become piled up or collected in layers while maintaining the orientation of the bobbins. The wedge-shaped bases 27, 28 enable the temporary container 18 to be empted while safely maintaining the orientation of the bobbins of yarn.

To enable the filled temporary container 18 to be removed, the container is provided with a slide 31 (not shown in detail), by means of which the opening 19 of the temporary container can be closed.

Alternatively, the temporary container may have an inclined position whereby it is unnecessary to provide double wedge bases and without any danger to the proper maintenance of the orientation of the bobbins of yarn within the temporary container.

The apparatus described above for orienting and for automatically collecting bobbins of yarn may be modified in many ways without thereby departing from the scope of the invention. Thus, it is quite clear for persons acquainted with the art that the introduction of the bobbins of yarn into the temporary container may be effectd either laterally and/or at a certain angle with respect to the vertical. Furthermore, various embodiments of the positioning device, the lifting unit and of the driving mechanism are possible. The lifting unit may be actuated pneumatically or hydraulically, instead of mechanically.

I claim:

1. Apparatus for orienting and for automatically collecting bobbins of yarn wound on a winding device of a winding-up maching, comprising an inclined channel member arranged for bobbins of yarn of a predetermined size to slide therealong from the winding-up machine, said channel having a width smaller than the length of a bobbin of yarn of said predetermined size and larger than the outer diameter of said bobbin of yarn so that said bobbins of yarn slide along said channel member with a constant orientation relatively thereto, a positioning device for locating each bobbin of yarn after travelling along said channel member in a fixed position at the lower end of said inclined channel member, said positioning device being formed with an aperture and shaped to locate a bobbin of yarn received from said channel above said aperture, a container temporarily mounted above said positioning device and formed with an opening in its base through which bobbins of yarn may be introduced in sequence into said container, a lifting unit including a thrust member shaped and arranged to raise through said aperture to engage a bobbin of yarn thereabove and carry said bobbin of yarn through said opening and closure means for said opening comprising two flaps respectively mounted on two spring-loaded upwardly extending support member which in the closing position of said closure means locate said flaps edge to edge across said opening, said support members being pivotally mounted and located to be thrust away from one another, so as to separate said flaps, by a bobbin of yarn rising on said thrust member into said container, said thrust member and said support members being mutually formed so as to permit said two flaps to approach one another and close said container beneath said bobbin of yarn immediately after said bobbin of yarn has been raised by said thrust member substantially wholly above said flaps.

2. Apparatus according to claim 1, in which said lifting unit comprises a vertical member mounted for vertical reciprocation, said thrust member being mounted on said vertical member, the apparatus comprising also means for reciprocating said vertical member and means for connecting said reciprocating means to operate in timed relationship with the winding-up machine.

* * * * *